United States Patent [19]

Harrison

[11] Patent Number: 5,011,814

[45] Date of Patent: Apr. 30, 1991

[54] THERMAL DYE TRANSFER RECEIVING ELEMENT WITH POLYETHYLENE OXIDE BACKING LAYER

[75] Inventor: Daniel J. Harrison, Rochester, N.Y.

[73] Assignee: Eastman Kodak Company, Rochester, N.Y.

[21] Appl. No.: 485,676

[22] Filed: Feb. 27, 1990

[51] Int. Cl.[5] ..... B41M 5/035; B41M 5/26

[52] U.S. Cl. ..... 503/227; 8/471; 428/195; 428/206; 428/211; 428/327; 428/331; 428/913; 428/914

[58] Field of Search ..... 8/471; 428/195, 206, 428/211, 327, 331, 913, 914, 513; 503/227

[56] References Cited

U.S. PATENT DOCUMENTS

| | | | |
|---|---|---|---|
| 4,717,711 | 1/1988 | Vanier et al. | 503/227 |
| 4,814,321 | 3/1989 | Campbell . | |
| 4,820,686 | 4/1989 | Ito et al. . | |
| 4,828,971 | 5/1989 | Przezdziecki . | |

FOREIGN PATENT DOCUMENTS

| | | |
|---|---|---|
| 0351075 | 1/1990 | European Pat. Off. . |
| 01047586 | 2/1989 | Japan . |

*Primary Examiner*—Bruce H. Hess
*Attorney, Agent, or Firm*—Andrew J. Anderson

[57] ABSTRACT

A dye-receiving element for thermal dye transfer includes a support having on one side thereof a polymeric dye image-receiving layer and on the other side thereof a backing layer made from a mixture of polyethylene oxide and submicron colloidal inorganic particles.

17 Claims, No Drawings

THERMAL DYE TRANSFER RECEIVING ELEMENT WITH POLYETHYLENE OXIDE BACKING LAYER

This invention relates to dye-receiving elements used in thermal dye transfer, and more particularly to the backing layer of such elements.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

Dye receiving elements for thermal dye transfer generally include a support bearing on one side thereof a dye image-receiving layer and on the other side thereof a backing layer. The backing layer material is chosen to (1) provide adequate friction to a rubber pick roller to allow for removal of one receiver element at a time from a receiver element supply stack, (2) minimize interactions between the front and back surfaces of receiving elements such as dye retransfer from one imaged receiving element to the backing layer of an adjacent receiving element in a stack of imaged elements, and (3) minimize sticking between a dye-donor element and the receiving element backing layer when the receiving element is accidentally inserted into a thermal printer wrong side up.

One backing layer which has found use for dye-receiving elements is a mixture of polyethylene glycol (a double-end hydroxy terminated ethylene oxide polymer) and submicron colloidal silica. This backing layer functions well to minimize interactions between the front and back surfaces of receiving elements and to minimize sticking to a dye-donor element when the receiving element is used wrong side up. This backing layer also provides adequate friction to a rubber pick roller to allow removal of one receiving element at a time from a stack under normal room temperature conditions (20° C., 50% relative humidity). At higher temperatures and relative humidity, e.g. tropical conditions (30° C., 91% relative humidity), however, this backing layer becomes too lubricious and does not allow for effective removal of receiving elements one at a time from a supply stack.

It would be desirable to provide a backing layer for a dye-receiving element which would minimize interactions between the front and back surfaces of such elements, minimize sticking to a dye-donor element, and provide adequate friction to a rubber pick roller to allow for removal of one receiver element at a time from a receiver element supply stack under high temperature and high relative humidity conditions.

These and other objects are achieved in accordance with this invention which comprises a dye-receiving element for thermal dye transfer comprising a support having on one side thereof a polymeric dye image-receiving layer and on the other side thereof a backing layer, wherein the backing layer comprises a mixture of polyethylene oxide (a single-end hydroxy terminated ethylene oxide polymer) and submicron colloidal inorganic particles, the mixture not containing more than about 20 wt. % polyethylene oxide.

The process of forming a dye transfer image in a dye-receiving element in accordance with this invention comprises removing an individual dye-receiving element as described above from a supply stack of dye-receiving elements, moving the individual receiving element to a thermal printer printing station and into superposed relationship with a dye-donor element comprising a support having thereon a dye-containing layer so that the dye-containing layer of the donor element faces the dye image-receiving layer of the receiving element, and imagewise heating the dye-donor element thereby transferring a dye image to the individual receiving element. The process of the invention is applicable to any type of thermal printer, such as a resistive head thermal printer, a laser thermal printer, or an ultrasound thermal printer.

In accordance with this invention, it has been found that by using polyethylene oxide in place of polyethylene glycol in the backing layer mixture, adequate friction is achieved between a rubber pick roller and the backing layer even under high temperature and relative humidity conditions. In order to minimize accidental sticking to a dye-donor element, the mixture of polyethylene oxide and submicron colloidal inorganic particles should not contain more than about 20 wt. % polyethylene oxide. In a preferred embodiment, the backing layer mixture comprises from about 5 wt. % to about 20 wt. % polyethylene oxide. In a most preferred embodiment, the mixture comprises from about 10 wt. % to about 20 wt. % polyethylene oxide.

Any submicron colloidal inorganic particles may be used in the backing layer mixture of the invention. Preferably, the particles are water dispersible. There may be used, for example, silica, alumina, titanium dioxide, barium sulfate, etc. In a preferred embodiment, silica particles are used.

The backing layer may be present in any amount which is effective for the intended purpose. In general, good results have been obtained at a concentration of from about 0.5 to about 2 $g/m^2$.

The support for the dye-receiving element of the invention may be a polymeric, a synthetic paper, or a cellulosic paper support. In a preferred embodiment, a paper support is used. In a further preferred embodiment, a polymeric layer is present between the paper support and the dye image-receiving layer. For example, there may be employed a polyolefin such as polyethylene or polypropylene. In a further preferred embodiment, white pigments such as titanium dioxide, zinc oxide, etc., may be added to the polymeric layer to provide reflectivity. In addition, a subbing layer may be used over this polymeric layer in order to improve adhesion to the dye image-receiving layer. In a further preferred embodiment, a polymeric layer such as a polyolefin layer may also be present between the paper support and the backing layer, e.g. in order to prevent curl.

The polymeric dye image-receiving layer of the dye-receiving element of the invention may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

In a preferred embodiment of the invention, the dye image-receiving layer is a polycarbonate. The term "polycarbonate" as used herein means a polyester of carbonic acid and a glycol or a dihydric phenol. Examples of such glycols or dihydric phenols are p-xylylene glycol, 2,2-bis(4-oxyphenyl)propane, bis(4-oxyphenyl)methane, 1,1-bis(4-oxyphenyl)ethane, 1,1-bis-(oxyphenyl)butane, 1,1-bis(oxyphenyl)cyclohexane, 2,2-bis(oxyphenyl)butane, etc.

In another preferred embodiment of the invention, the polycarbonate dye image-receiving layer comprises a bisphenol-A polycarbonate having a number average molecular weight of at least about 25,000. In still another preferred embodiment of the invention, the bisphenol-A polycarbonate comprises recurring units having the formula

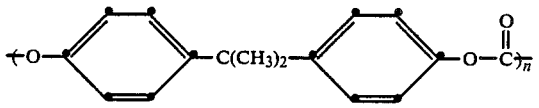

wherein n is from about 100 to about 500.

Examples of such polycarbonates include General Electric Lexan® Polycarbonate Resin #ML-4735 (Number average molecular weight app. 36,000), and Bayer AG Makrolon #5705® (Number average molecular weight app. 58,000). The later material has a $T_g$ of 150° C.

A dye-donor element that is used with the dye-receiving element of the invention comprises a support having thereon a dye containing layer. Any dye can be used in used in such a layer provided it is transferable to the dye image-receiving layer of the dye-receiving element of the invention by the action of heat. Especially good results have been obtained with sublimable dyes. Examples of sublimable dyes include anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

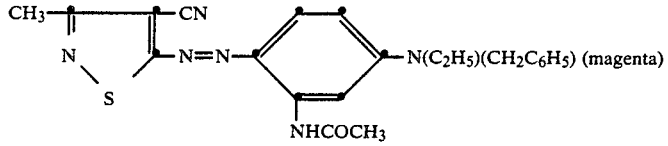

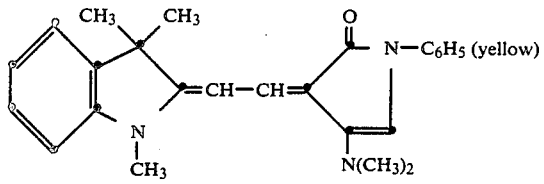

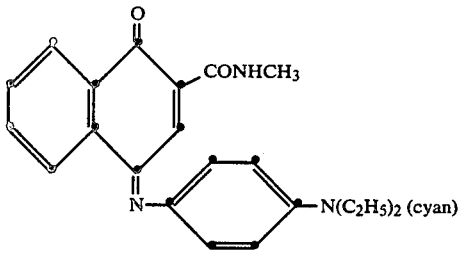

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly-(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 2 to about 30 μm. It may also be coated with a subbing layer, if desired.

A dye-barrier layer comprising a hydrophilic polymer may also be employed in the dye-donor element between its support and the dye layer which provides improved dye transfer densities. Such dye-barrier layer materials include those described and claimed in U.S. Pat. No. 4,700,208 of Vanier et al, issued Oct. 13, 1987.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Examples of such lubricating materials include oils or semi-crystalline organic solids that melt below 100° C. such as poly(vinyl stearate), beeswax, perfluorinated alkyl ester polyethers, phosphoric acid esters, silicone oils, poly(caprolactone), carbowax or poly-(ethylene glycols). Suitable polymeric binders for the slipping layer include poly(vinyl alcohol-co-butyral), poly(vinyl alcohol-co-acetal), poly(styrene), poly(styrene-co-acrylonitrile), poly(vinyl acetate), cellulose acetate butyrate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

As noted above, dye-donor elements are used to form a dye transfer image. Such a process comprises image-wise-heating a dye-donor element and transferring a dye image to a dye-receiving element as described above to form the dye transfer image.

The dye-donor element employed in certain embodiments of the invention may be used in sheet form or in a continuous roll or ribbon. If a continuous roll or ribbon is employed, it may have only one dye thereon or may have alternating areas of different dyes such as cyan, magenta, yellow, black, etc., as disclosed in U.S. Pat. No. 4,541,830.

In a preferred embodiment of the invention, a dye-donor element is employed which comprises a poly-(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer, such as laser or ultrasound, may be used.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following example is provided to illustrate the invention.

EXAMPLE

Dye-receivers were prepared by coating the following layers in order on white-reflective supports of titanium dioxide pigmented polyethylene overcoated paper stock:

(1) Subbing layer of poly(acrylonitrile-co-vinylidene chloride-co-acrylic acid) (14:79:7 wt. ratio) (0.08 g/m$^2$) coated from butanone solvent.

(2) Dye-receiving layer of diphenyl phthalate (0.32 g/m$^2$), di-n-butyl phthalate (0.32 g/m$^2$), Fluorad FC-431® (a perfluorosulfonamido surfactant of 3M Corp.) (0.01 g/m$^2$), Makrolon 5700® (a bisphenol-A polycarbonate of Bayer AG) (1.6 g/m$^2$), and a linear condensation polymer derived from carbonic acid, bisphenol-A, and diethylene glycol (phenol:glycol mol ratio 50:50) (1.6 g/m$^2$) coated from dichloromethane solvent.

(3) Overcoat layer of Fluorad FL-431® (0.02 g/m$^2$), DC-510® Silicone Fluid (a mixture of dimethyl and methylphenyl siloxanes of Dow Corning) (0.02 g/m$^2$) in the linear condensation polymer described above (0.22 g/m$^2$) coated from dichloromethane solvent.

On the reverse (back) side of these supports a layer of high-density polyethylene (32 g/m$^2$) was extrusion coated. On top of this layer, backing layers of the invention or comparison backing layers were coated from a water and isobutyl alcohol solvent mixture. The backing layers contained either polyethylene oxide (Polyox® series of Union Carbide), polyethylene glycol (Scientific Polymer Products), or polypropylene glycol (Scientific Polymer Products) of molecular weights and coverages indicated in the table below, and colloidal silica (Ludox AM® alumina modified colloidal silica of duPont) of approximately 0.014 μm diameter and coverages indicated below. For coating ease, all backing layers contained Triton X-200® (a sulfonated aromatic-aliphatic surfactant of Rohm and Haas) (0.09 g/m$^2$)

and Daxad-30® (sodium polymethacrylate of W. R. Grace Chem. Co.) (0.02 g/m²), and varying amounts of hydroxyethylcellulose up to 0.6 g/m² were added to adjust viscosity.

To evaluate receiver backing layer friction, each dye receiver tested was placed face down (dye image-receiving layer side down) on top of a stack of face down receivers having the polyethylene glycol control backing layer. Two pick rollers (12 mm wide and 28 mm in diameter with an outer 2 mm layer of Kraton® G2712X rubber) of a commercial thermal printer (Kodak® SV6500 Color Video Printer) were lowered onto the top test receiver so as to come into contact with the backing layer to be tested. The rollers were stalled at a fixed position so that they could not rotate, and supplied a normal force of approximately 400 g to the receiver backing layer. Before testing, the pick-rollers were cleaned with water and dried. The test equipment and the receivers to be tested were incubated for one hour at the desired test conditions of 30° C., 91% relative humidity. A spring type force scale (Chatillon 2 kg×26 g scale) was attached to the test receiver and was used to pull it at a rate of 0.5 cm/sec from the receiver stack. Clean sections of the rollers were used for each test as any contamination of the rollers could significantly alter the measured friction. The required pull forces for the various backing layers are indicated in the table below. In actual practice, it has been found that pull forces of at least about 400 g are desired and that forces of about 600 g or more are preferable to ensure good picking reliability.

To evaluate sticking between a receiver backing layer and a dye-donor, a high-density image was printed using a Kodak® SV6500 Color Video Printer and having the receiver being tested inserted wrong-side up. A dye-donor having alternating sequential areas of cyan, magenta and yellow dye similar to that described in Example 2 of copending, commonly assigned U.S. Ser. No. 345,049 of Bailey et al, filed Apr. 28, 1989, which is hereby incorporated by reference, was used. The dye donor was brought into contact with the backing layer of a receiver, and the assemblage was clamped to the stepper-motor driven rubber roller of the Color Video Printer. The thermal print head of the printer was pressed against the dye-donor element side of the assemblage pushing it against the rubber roller. The printer's imaging electronics were activated causing the assemblage to be drawn between the print head and roller, and a stepped density pattern was generated by pulsing the resistive elements in the thermal print head at varying rates, similar to the printing procedure described in Example 2 of U.S. Ser. No. 345,049 incorporated by reference above. Ideally, no sticking of the donor to the receiver backing layer should occur where a print is attempted when the receiver is accidentally inserted wrong side up. The test results for sticking to the various backing layers are given in the table below.

| Backing Layer Polymer Type | Silica g/m² | Polymer g/m² | Polymer wt % | Pull Force (g) | Donor to Backing Layer Sticking |
|---|---|---|---|---|---|
| No backing layer (bare polyethylene) | — | — | — | 700 | None |
| PEG (400) (Control) | 1.4 | 0.67 | 32. | 260 | None |
| PEG (400) | 1.0 | 0.45 | 31. | 390 | None |
| PEG (400) | 0. | 1.0 | 100. | 300 | (nd) |

-continued

| Backing Layer Polymer Type | Silica g/m² | Polymer g/m² | Polymer wt % | Pull Force (g) | Donor to Backing Layer Sticking |
|---|---|---|---|---|---|
| PEG (3350) | 1.0 | 0.45 | 31. | 320 | None |
| PEG (3350) | 1.0 | 0.45 | 31. | 340 | None |
| PEG (3350) | 1.0 | 0.45 | 31. | 440 | None |
| PEG (6000) | 1.0 | 0.45 | 31. | 410 | None |
| PEG (8000) | 1.0 | 0.45 | 31. | 430 | None |
| PPG (4000) | 1.0 | 0.45 | 31. | 810 | Yes |
| PPG (4000) | 0.8 | 0.36 | 31. | 740 | Yes |
| PPG (4000) | 0.8 | 0.20 | 21. | 810 | Yes |
| PPG (4000) | 1.3 | 0.20 | 14. | 780 | Yes |
| PPG (4000) | 1.8 | 0.20 | 10. | 810 | Yes |
| PEO (300K) | 0.8 | 0.36 | 31. | 780 | Yes |
| PEO (300K) | 1.0 | 0.45 | 31. | 720 | Yes |
| PEO (300K) | 0.8 | 0.24 | 23. | 610 | Yes |
| PEO (300K) | 0.9 | 0.26 | 23. | 460 | Yes |
| PEO (300K) | 0.7 | 0.19 | 23. | 440 | Yes |
| PEO (300K) | 0.8 | 0.20 | 21. | 620 | None |
| PEO (300K) | 1.1 | 0.27 | 20. | 540 | Yes |
| PEO (300K) | 0.9 | 0.22 | 20. | 530 | None |
| PEO (300K) | 0.7 | 0.16 | 20. | 520 | None |
| PEO (300K) | 1.4 | 0.27 | 17. | 720 | None |
| PEO (300K) | 1.1 | 0.22 | 17. | 700 | None |
| PEO (300K) | 0.9 | 0.17 | 17. | 630 | None |
| PEO (300K) | 0.7 | 0.13 | 17. | 540 | None |
| PEO (300K) | 1.0 | 0.16 | 14. | 710 | None |
| PEO (300K) | 1.1 | 0.16 | 13. | 660 | None |
| PEO (300K) | 0.9 | 0.13 | 13. | 610 | None |
| PEO (300K) | 0.7 | 0.10 | 13. | 490 | None |
| PEO (300K) | 0.9 | 0.13 | 13. | 490 | None |
| PEO (200K) | 0.9 | 0.13 | 13. | 470 | None |
| PEO (100K) | 0.9 | 0.13 | 13. | 500 | None |
| PEO (100K) | 0.9 | 0.13 | 13. | 440 | None |
| PEO (100K) | 0.9 | 0.13 | 13. | 430 | None |
| PEO (300K) | 0.9 | 0.10 | 10. | 700 | None |
| PEO (300K) | 1.1 | 0.11 | 9. | 490 | None |
| PEO (300K) | 0.9 | 0.09 | 9. | 460 | None |
| PEO (300K) | 0.8 | 0.08 | 9. | 500 | None |
| PEO (300K) | 0.7 | 0.06 | 9. | 420 | None |
| PEO (300K) | 1.2 | 0.08 | 6. | 500 | None |
| PEO (300K) | 1.1 | 0.05 | 5. | 440 | None |
| None | 1.0 | 0. | 0. | 780 | Yes |

PEG = polyethylene glycol
PPG = polypropylene glycol
PEO = polyethylene oxide
nd = not determined
(Nominal molecular weights for the backing layer polymers are given in parentheses)

The above results demonstrate that backing layers of polyethylene oxide mixed with colloidal particles provide improved friction characteristics compared to the control prior art backing layer of polyethylene glycol mixed with colloidal silica particles. At polyethylene oxide concentrations less than about 20 wt. %, no sticking occurs between the backing layer and a dye-donor element. The above results also demonstrate the superiority of polyethylene oxide over other polymers such as polypropylene glycol, which sticks to a dye donor even at concentrations of less than 20 wt. % in the backing layer. The above results indicate a high pull force and no sticking for bare polyethylene in the absence of any backing layer, but polyethylene alone does not perform well at preventing interactions between the front and back surfaces of receiving elements such as dye retransfer, and as such is not a satisfactory backing layer itself. While the molecular weights of the polyethylene oxides used in the above examples ranged from 100,000 to 300,000 due to commercial availability, the molecular weight is not believed to be particularly critical and lower and higher molecular weights are expected to also function well.

The invention has been described in detail with particular reference to preferred embodiments thereof, but it will be understood that variations and modifications can be effected within the spirit and scope of the invention.

What is claimed is:

1. In a dye-receiving element for thermal dye transfer comprising a support having on one side thereof a polymeric dye image-receiving layer and on the other side thereof a backing layer, the improvement wherein said backing layer comprises a mixture of polyethylene oxide and submicron colloidal inorganic particles, said mixture not containing more than about 20 wt. % polyethylene oxide.

2. The element of claim 1, wherein said support comprises paper.

3. The element of claim 2, further comprising a polyolefin layer between said support and said backing layer.

4. The element of claim 3, wherein said particles comprise silica.

5. The element of claim 4, wherein said mixture comprises from about 10 wt. % to about 20 wt. % polyethylene oxide.

6. The element of claim 3, wherein said mixture comprises from about 10 wt. % to about 20 wt. % polyethylene oxide.

7. The element of claim 2, wherein said mixture comprises from about 10 wt. % to about 20 wt. % polyethylene oxide.

8. The element of claim 1, wherein said mixture comprises from about 10 wt. % to about 20 wt. % polyethylene oxide.

9. In a dye-receiving element for thermal dye transfer comprising a paper support having on one side thereof a polymeric dye image-receiving layer and on the other side thereof a backing layer, the improvement wherein said backing layer comprises from about 5 wt. % to about 20 wt. % polyethylene oxide and from about 80 wt. % to about 95 wt. % submicron colloidal silica particles.

10. In a process of forming a dye transfer image in a dye-receiving element comprising:

(a) removing an individual dye-receiving element comprising a support having on one side thereof a polymeric dye image-receiving layer and on the other side thereof a backing layer from a stack of dye-receiving elements;

(b) moving said individual dye-receiving element to a thermal printer printing station and into superposed relationship with a dye-donor element comprising a support having thereon a dye-containing layer so that the dye-containing layer of the donor element faces the dye image-receiving layer of the receiving element; and (c) imagewise-heating said dye-donor element and thereby transferring a dye image to said individual dye-receiving element;

the improvement wherein said backing layer comprises a mixture of polyethylene oxide and submicron colloidal inorganic particles, said mixture not containing more than about 20 wt. % polyethylene oxide.

11. The process of claim 10, wherein the receiving element support comprises paper.

12. The process of claim 11, wherein said receiving element further comprises a polyolefin layer between the paper support and the backing layer.

13. The process of claim 12, wherein said particles comprise silica.

14. The process of claim 13, wherein said mixture comprises from about 10 wt. % to about 20 wt. % polyethylene oxide.

15. The process of claim 12, wherein said mixture comprises from about 10 wt. % to about 20 wt. % polyethylene oxide.

16. The process of claim 11, wherein said mixture comprises from about 10 wt. % to about 20 wt. % polyethylene oxide.

17. The process of claim 10, wherein said mixture comprises from about 10 wt. % to about 20 wt. % polyethylene oxide.

* * * * *